US008830024B2

(12) United States Patent
Buettner

(10) Patent No.: US 8,830,024 B2
(45) Date of Patent: Sep. 9, 2014

(54) DEVICE FOR RECEIVING A FUSE AND SWITCHING DEVICE

(75) Inventor: Alex Buettner, Roedental (DE)

(73) Assignee: Woehner GmbH & Co. KG Elektrotechnische Systeme, Roedental (DE)

( * ) Notice: Subject to any disclaimer, the term of this patent is extended or adjusted under 35 U.S.C. 154(b) by 228 days.

(21) Appl. No.: 13/101,405

(22) Filed: May 5, 2011

(65) Prior Publication Data

US 2011/0273262 A1 Nov. 10, 2011

(30) Foreign Application Priority Data

May 6, 2010 (DE) ..... 10 2010 028 685

(51) Int. Cl.

| | |
|---|---|
| ***H01H 37/64*** | (2006.01) |
| ***H01H 85/20*** | (2006.01) |
| ***H01H 85/54*** | (2006.01) |
| ***H01H 31/12*** | (2006.01) |

(52) U.S. Cl.

CPC ..... *H01H 85/545* (2013.01); *H01H 31/122* (2013.01); *H01H 85/2015* (2013.01)

USPC ..... 337/215; 337/181; 337/196; 337/209; 337/413

(58) Field of Classification Search

USPC ..... 337/181, 196, 209, 413, 215

See application file for complete search history.

(56) References Cited

U.S. PATENT DOCUMENTS

| | | | | | |
|---|---|---|---|---|---|
| 743,471 | A | * | 11/1903 | Downes | 337/196 |
| 1,158,535 | A | * | 11/1915 | Murray | 337/196 |
| 1,429,275 | A | * | 9/1922 | Burnham | 337/196 |
| 1,857,442 | A | * | 5/1932 | Dohrwardt | 337/196 |
| 1,953,343 | A | * | 4/1934 | Frank | 337/194 |
| 1,954,186 | A | * | 4/1934 | Steinmayer | 337/196 |
| 1,966,716 | A | * | 7/1934 | Green | 337/194 |
| 1,993,866 | A | * | 3/1935 | Steinmayer | 337/203 |
| 2,011,391 | A | * | 8/1935 | Bennett | 337/196 |
| 2,011,543 | A | * | 8/1935 | Meyer | 337/212 |
| 2,026,381 | A | * | 12/1935 | Fiedler | 337/206 |

(Continued)

FOREIGN PATENT DOCUMENTS

| | | | |
|---|---|---|---|
| CN | 1121153 | A | 4/1996 |
| CN | 1447366 | A | 10/2003 |

(Continued)

OTHER PUBLICATIONS

Chinese Search Report for Chinese Application No. CN 2011101227803, dated Apr. 23, 2013, 2 pages.

(Continued)

*Primary Examiner* — Anatoly Vortman

(74) *Attorney, Agent, or Firm* — Westman, Champlin & Koehler, P.A.

(57) ABSTRACT

A device for receiving a cylindrical fuse, having a housing which has member pairs which protrude from a housing base and which are spaced-apart from each other, wherein a substantially U-shaped contact is introduced in each case between the members of each member pair and the member pairs are provided for receiving the fuse, wherein each substantially U-shaped contact is formed by two contact members, of which at least one of the contact members is provided with a contact tongue which protrudes laterally over the contact members, the contact tongue(s) defining a contact blade.

13 Claims, 5 Drawing Sheets

(56) References Cited

U.S. PATENT DOCUMENTS

| | | | | | |
|---|---|---|---|---|---|
| 2,077,207 | A | * | 4/1937 | Birkenmaier | 337/152 |
| 2,098,559 | A | * | 11/1937 | Anderson | 337/196 |
| 2,361,666 | A | * | 10/1944 | Triplett | 337/240 |
| 2,379,199 | A | * | 6/1945 | Triplett | 337/180 |
| 2,404,230 | A | * | 7/1946 | Harlow et al. | 337/196 |
| 2,700,712 | A | * | 1/1955 | Stinson | 337/193 |
| 2,905,791 | A | * | 9/1959 | Edmunds | 337/199 |
| 3,432,789 | A | * | 3/1969 | Poehlman, Jr. | 337/242 |
| 4,128,291 | A | | 12/1978 | Peterson, Jr. | |
| 4,778,959 | A | * | 10/1988 | Sabatella et al. | 218/1 |
| 5,082,452 | A | | 1/1992 | Takano | |
| 5,597,329 | A | | 1/1997 | Takano et al. | |
| 6,587,028 | B2 | * | 7/2003 | Mollet et al. | 337/194 |
| 6,727,797 | B1 | * | 4/2004 | Bruchmann | 337/210 |
| 7,948,353 | B2 | * | 5/2011 | Deno et al. | 337/205 |
| 7,982,578 | B2 | * | 7/2011 | Buettner | 337/196 |

FOREIGN PATENT DOCUMENTS

| | | | |
|---|---|---|---|
| CN | 101552165 | A | 10/2009 |
| DE | 8601549.4 | U1 | 5/1986 |
| DE | 102006022374 | | 11/2007 |
| DE | 2008016648 | | 10/2009 |
| EP | 2 112 675 | A2 | 10/2009 |

OTHER PUBLICATIONS

European Search Report from EP Application No. 11164512.3, dated Aug. 10, 2011.

Chinese Office Action from CN Application No. 201110122780.3, dated May 2, 2013.

Translation of Chinese Office Action from CN Application No. 201110122780.3, dated May 2, 2013.

Notification of the Second Office Action for Chinese Patent Application No. 201110122780.3, dated Jan. 30, 2014, 18 pages.

* cited by examiner

DEVICE FOR RECEIVING A FUSE AND SWITCHING DEVICE

CROSS-REFERENCE TO RELATED APPLICATIONS

This application claims the benefit of German Patent Application No. 10 2010 028 685.0, filed May 6, 2010, the entire disclosure of which is herein incorporated by reference.

FIELD OF THE INVENTION

Switching devices comprise a housing having a plurality of contact portions which are arranged parallel with each other, for example, lyre-shaped contacts in which, for example, LVHRC (low-voltage high-rupture-capacity) fuses with end face contact blades are placed. The fuses are preferably arranged parallel with each other at the lower side of a cover which is articulated so as to be able to be pivoted relative to the housing which contains the contact portions. By the cover being pivoted upwards, the fuses are moved away from the contact portions and, by closing the cover, the fuses are introduced with their contact blades into the contact portions of the housing (DE 10 2006 022 374 A1). Instead of directly securing the LVHRC fuses to the lower side of the cover, it is possible to provide receiving cages into which the fuses are introduced (DE 10 2008 016 648 A1). With such a switching device, in particular load breaking switches, there are provided on the lower side of the cover devices for receiving, a receiving device for fuses, respectively, in such a manner that the fuses, when introduced into the respective device, can be secured to the lower side of the cover together with the device.

Problems arise when, instead of LVHRC fuses with contact blades, cylindrical fuses are used which have cap-like contacts at the end faces thereof. For such cylindrical fuses, a switching device with contact portions in the form of lyre-shaped contacts is not suitable. Instead, the housings must contain contact portions which are specially adapted for the use of cylindrical fuses. Such cylindrical fuses are conventional in the USA and are known there as cylindrical fuses of class J. Such cylindrical fuses have no laterally protruding contact blades.

In order to allow the use of cylindrical fuses, in particular of the type J30 or J60 in such switching devices, which are in principle configured for so-called LVHRC fuses, there are proposed reduction elements or adapters which comprise a metal cylindrical cap which can be pushed laterally onto the contact pieces of cylindrical fuses, the cylindrical caps being formed by two members with a base and a contact blade which protrudes from the base. A soldering or welding operation is carried out between the cap and the members. Although such reduction pieces or adapters in principle allow the use of cylindrical fuses in switching devices for LVHRC fuses, that is to say, switching devices with lyre-shaped contacts, these adapters must in each case be laterally pushed by hand onto the fuses, before they can be pushed together with the fuse into the lyre-shaped contacts. In addition, it must be ensured that, when these adapters are used, they have been completely pushed laterally onto the cylindrical fuses. This method is therefore very complex.

SUMMARY OF THE INVENTION

An object of the invention is to provide a device for receiving fuses and a switching device by means of which it is possible to use cylindrical fuses of class J with switching devices which are configured per se for LVHRC fuses.

This object is achieved by a device for receiving a fuse, in particular a cylindrical fuse, having a housing which has member pairs which protrude from a housing base and which are spaced-apart from each other, and wherein a substantially U-shaped contact is introduced in each case between the members of each member pair and the member pairs are provided for receiving the fuse, wherein each substantially U-shaped contact is formed by two contact members, of which at least one of the contact members is provided with a contact tongue which protrudes laterally over the contact members.

The invention provides for a device for receiving cylindrical fuses, in particular of class J, in particular J30 and J60 (US standard) which, in contrast to LVHRC fuses, do not contain any laterally protruding contact blades but instead are provided only with caps which form metal contacts but which, owing to the use of the device, can be used with switching devices having lyre-shaped contacts as contact receiving portions. Owing to the use of the device according to the invention, a typical switching device for LVHRC fuses can also be used for cylindrical fuses of class J30 and J60 without special refitting means or differently configured switching devices having to be provided.

The device according to the invention for receiving a cylindrical fuse comprises a housing, preferably of plastics material, which is defined by two member pairs which are spaced-apart from each other and which are connected to each other by means of a housing base, there being introduced in each member pair a substantially U-shaped metal contact which has at the end faces thereof two mutually parallel contact tongues which have substantially the shape and size of a contact blade. The U-shaped contacts serve to receive the metal-like caps of the cylindrical fuse.

Each switching device which is provided with the devices according to the invention has a cover which is preferably arranged so as to be able to be pivoted with respect to the housing which receives the lyre-shaped contacts. At the lower side of the cover, a plurality of the devices according to the invention for receiving a corresponding number of cylindrical fuses are removably arranged. Owing to the device according to the invention which is provided with end-side contact blades, the use of cylindrical fuses as an alternative to LVHRC fuses in a switching device configured in this manner is enabled thereby.

BRIEF DESCRIPTION OF THE DRAWINGS

Preferred embodiments of the device according to the invention and a switching device are described below in order to explain additional features. In the drawings.

DESCRIPTION OF EXEMPLARY EMBODIMENTS

Figure 1:
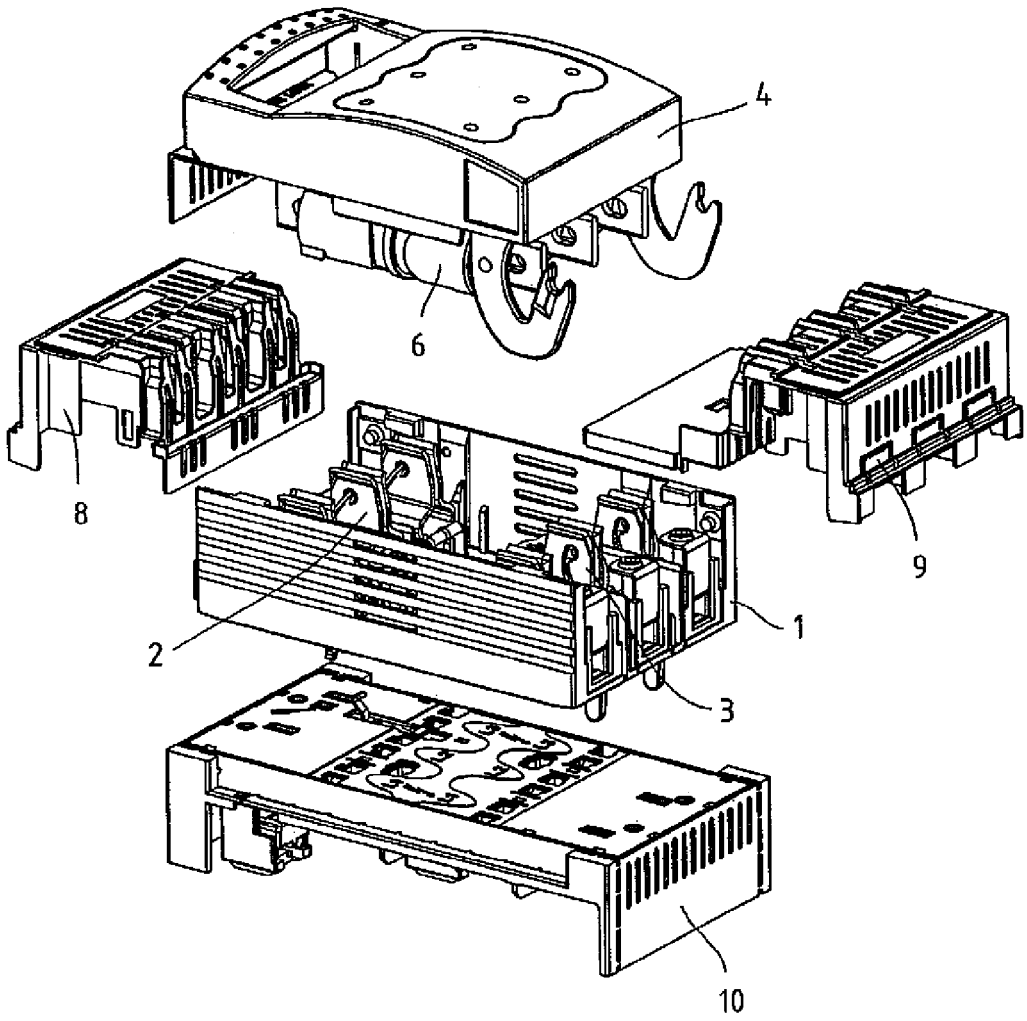
FIG. 1 is an example of a switching device having an adapter, which can be positioned on power rails.

FIG. 1 is a perspective view of a switching device, preferably a load breaking switch, which comprises a housing portion 1 having pairs of contact receiving portions 2, 3 which correspond to the number of fuses to be introduced and which are preferably in the form of lyre-shaped contacts which serve to receive the contact blades of the respective LVHRC fuses. There is further provided a cover 4 which is arranged so as to be able to be pivoted relative to the housing portion 1 and which carries at the lower side thereof a plurality of devices 6 for receiving LVHRC fuses, these devices 6 being removably fitted to the lower side of the housing 4. Hoods 8, 9 are used to cover the contact receiving portions 2, 3 etc. The hoods 8, 9 are intended to make the switching device touch-proof, that is to say, to prevent access to the contact portions 2, 3 located below the hoods 8, 9 which are preferably of plastics material. Such a switching device is preferably positioned on power rails which are not illustrated by means of an adapter 10.

Figure 2:
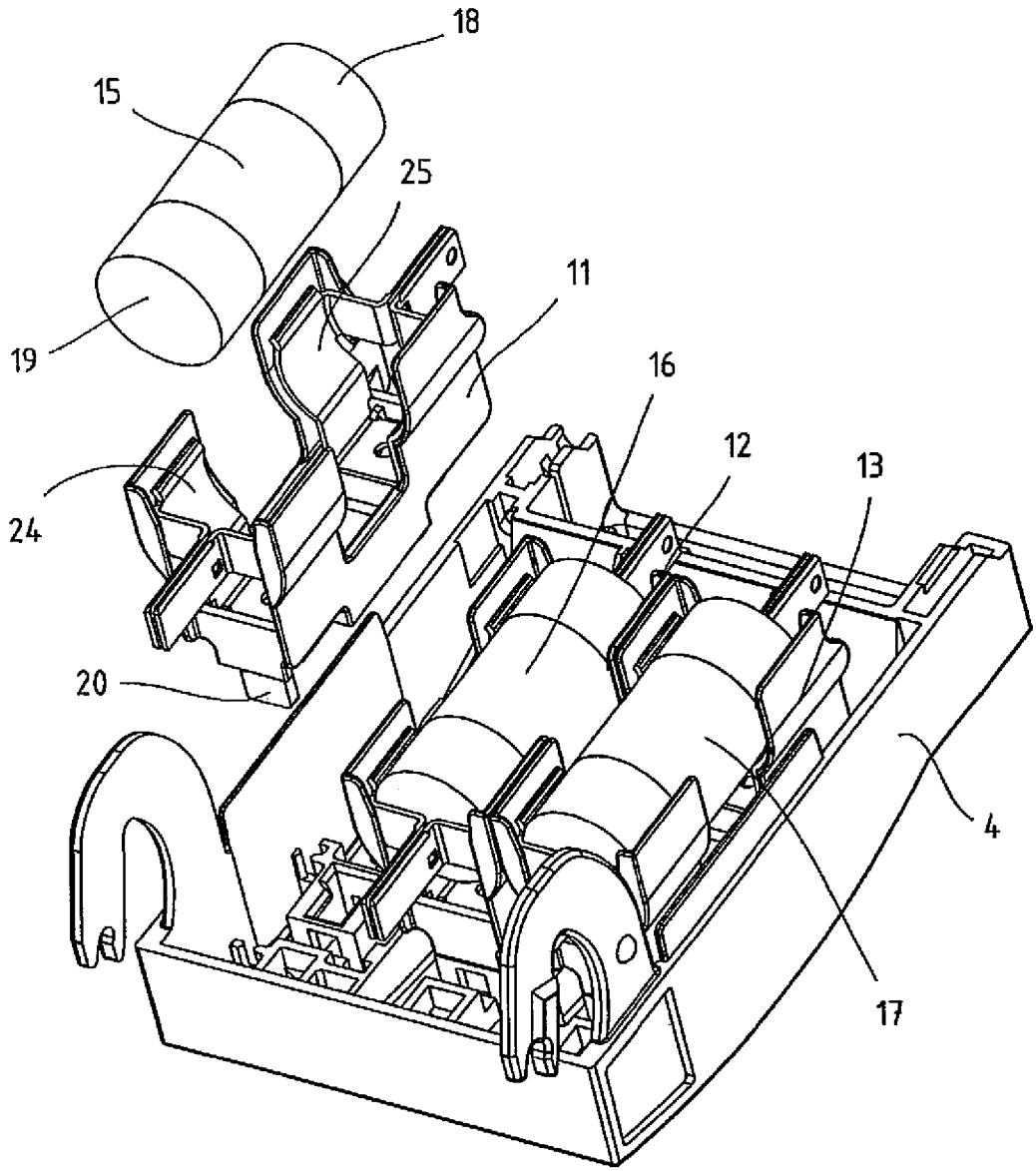
FIG. 2 is a view of the cover from below, with a plurality of devices according to the invention for receiving cylindrical fuses.

FIG. 2 is a perspective view of the lower side of the cover 4. According to FIG. 2, three devices 11, 12, 13 can be introduced into the cover 4. Each device 11, 12, 13 serves to receive a cylindrical fuse 15, preferably a cylindrical fuse of class J or J30 and J60 (US standard). Such cylindrical fuses have at the end face contact caps or contact heads 18, 19 as illustrated in FIG. 2 with reference to the fuse 15. Each of these devices 11, 12, 13 preferably has, at the side facing the cover 4, projections 20, 21 which serve to lock or otherwise secure the device 11, 12, 13 with respect to the cover 4, respectively.

In each device 11, 12, 13 there are provided substantially U-shaped contacts 24, 25 which are configured in such a manner that the cylindrical fuse 15 can be introduced into the contacts 24, 25 with the contact caps 18, 19. The electrical contact between each contact cap 18 and the contact 24 or the cap 19 and the contact 25 is thereby produced.

Figure 3:
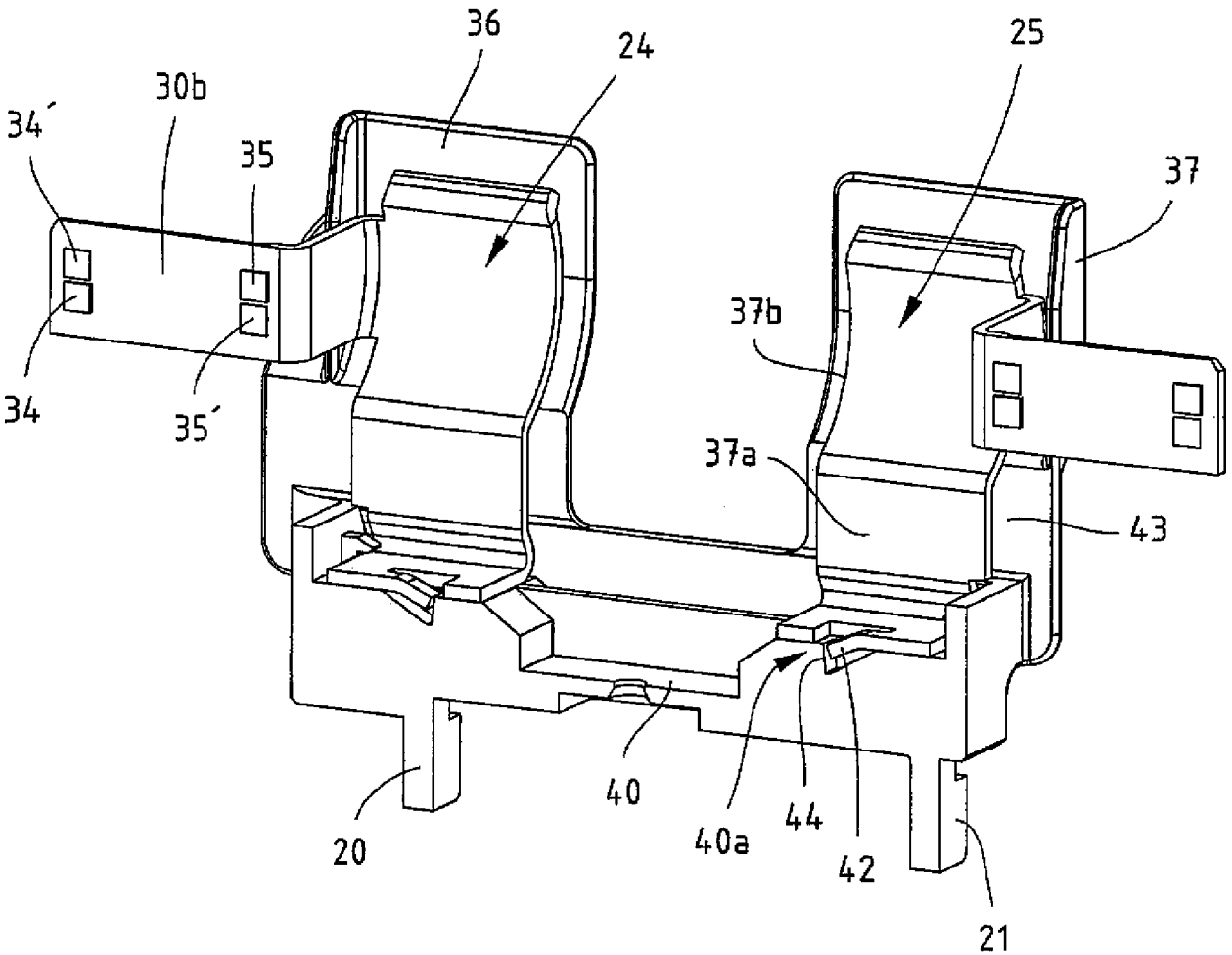
FIG. 3 is a sectioned view through a device according to the invention.

As can be seen from FIG. 3 ff., each contact 24, 25 is substantially U-shaped. Each contact 24, 25 contains two members 26, 27 which are spaced-apart from each other and which are connected to each other by means of a base 28, the base 28 preferably being constructed in a planar manner. The members 26, 27 comprise a portion 26*a*, 26*b* and 26*c*, or 27*a*, 27*b*, 27*c*. In this preferred configuration, the portions 26*a*, 27*a* protrude almost perpendicularly from the base 28 and merge into a curved region 26*b*, 27*b* which is adapted to the radius or diameter of the contact caps 18, 19 of the cylindrical fuses to be introduced. The portion 26*b*, 27*b* is adjoined by another laterally outwardly bent portion 26*c*, 27*c* which is intended to facilitate the introduction of the fuse into the contact 24, 25. Each member 26, 27 is provided with a contact tongue 30, 31 which, according to a preferred embodiment, comprises two portions, that is to say, a portion 30*a* and a portion 30*b* or 31*a*, 31*b*. The portion 30*a* or 31*a* is bent through approximately 90° relative to the associated member 26 or 27 and the portion 30*a* or 31*a* is adjoined, again at an angle of approximately 90°, by a straight portion 30*b* or 31*b*. The portions 30*b*, 31*b* extend parallel with each other and define a contact blade which is conventional in LVHRC fuses but which comprises two mutually parallel portions as explained above.

The contact blade portions 30*b*, 31*b* are orientated substantially centrally opposite or with respect to the longitudinal axis of the cylindrical fuse which is to be introduced, as can be seen from the illustration according to FIG. 2.

Each portion 30*b*, 31*b* has, at predetermined positions of the face directed towards the opposing portion 31*b*, 30*b*, projections 34, 35 which on the one hand serve to retain the two portions 30*b*, 31*b* with a predetermined spacing relative to each other. The spacing between the outer faces of the portions 30*b*, 31*b* substantially corresponds to the thickness of conventional contact blades. The projections 34, 35 further serve to produce good electrical contact between the portions 30*b*, 31*b*. The projections 34', 35' of the portion 31*b* are arranged so as to be offset relative to the projections 34, 35 according to FIG. 3 and the support faces on the portion 30*b* are indicated in FIG. 3 by the reference numerals 34', 35'.

The device according to the present invention preferably comprises a plastics material and has a base 40 which connects two mutually spaced-apart housing members 36, 37. The housing members 36, 37 comprise, similarly to the contacts 24, 25, a portion 37*a*, which protrudes upwards from the base 40 (FIG. 3) and which extends in a substantially straight manner, and an adjoining curved portion 37*b*. The same applies to the member 36. Consequently, the members 36, 37 are adapted to the shape of the contacts 24, 25 and form insulation or outward contact protection in relation to the contacts 24, 25. At the end faces of the device 11 or 12 or 13, the members 36, 37 are provided with a short wall 43 which extends substantially perpendicularly to the members 36, 37 and which at least partially closes the contacts 24, 25 at the end face of the device and prevents displacement of the contacts 24, 25 beyond the end face of the device.

When a cylindrical fuse is introduced into the contacts 24, 25, the members 26, 27 thereof become expanded, the members being surrounded by the housing members 36, 37 which surround them laterally and being limited with regard to the expansion thereof. The housing members 36, 37 define a predetermined pretension with respect to the members 26, 27, as a result of which the fuse is securely retained within the contacts 24, 25 by that pretension. Uncontrolled expansion of the contacts 24, 25 is therefore prevented by the contacts being enclosed by the housing members 36, 37.

In order to secure the metal contacts 24, 25, there is defined in the base 28 a bracket 42 which is bent downwards (in FIG. 3) and which engages in a notch 44 constructed in the base 40.

The device according to the invention comprises a housing and contacts 24, 25 which are introduced therein and which generally define a wide slot-like opening, via which the fuse 15 can be introduced in accordance with FIG. 2.

The two contacts 24, 25 are introduced into the device 11 with such spacing from each other that a close-fitting receiving of the fuse is ensured and the caps 18, 29 are moved into electrical contact with the members 26, 27.

The portions 30*b*, 31*b* of each contact 24, 25 have such dimensions in terms of size that, as set out, they correspond to the contact blades of conventional LVHRC fuses and can be moved into electrical contact and into engagement with contact portions or lyre-shaped contacts, as described in connection with FIG. 1 in relation to the housing portion 1.

Figure 5:
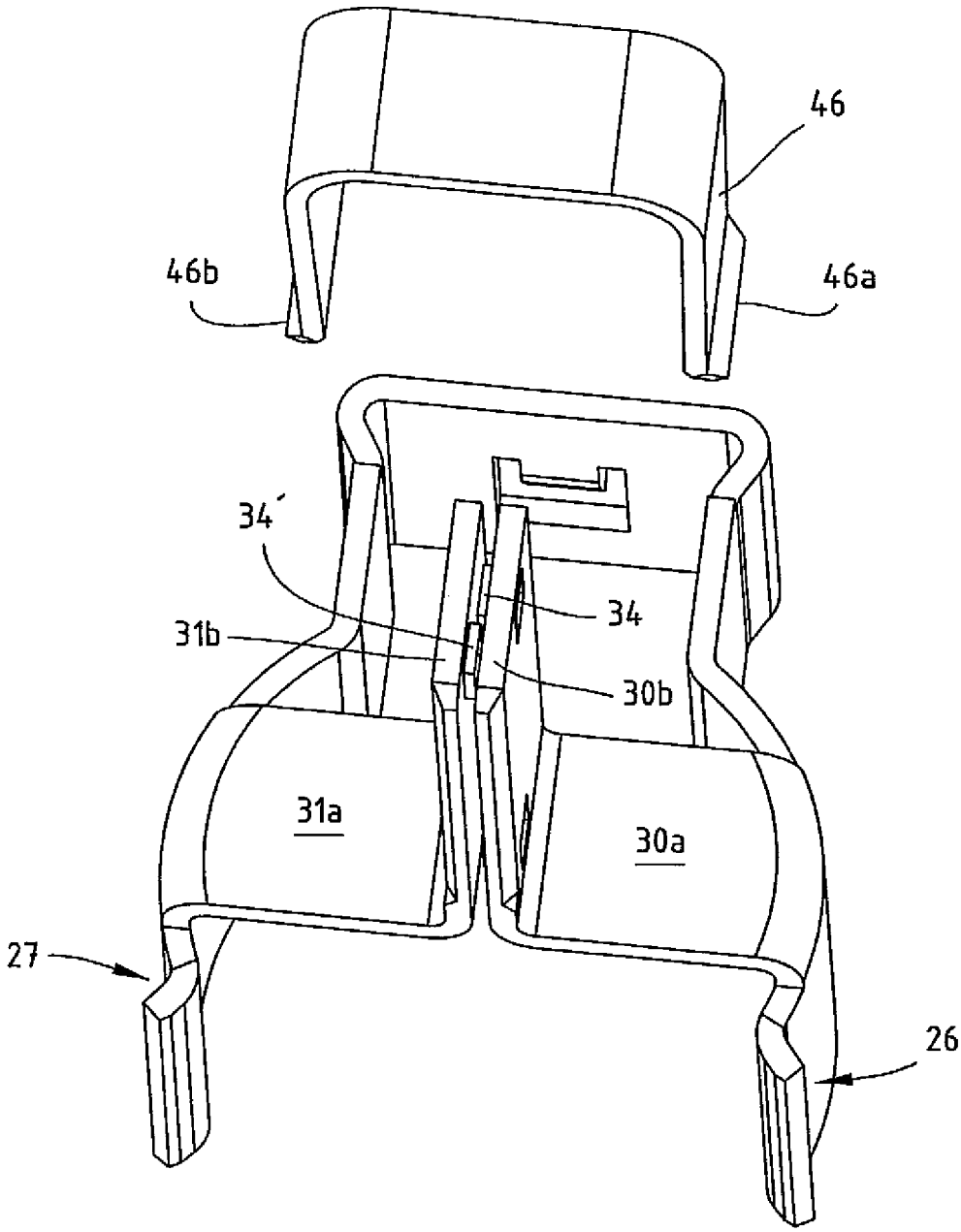
FIG. 5 is another perspective view of a contact together with a clamping spring.

According to another embodiment of the device according to the invention, according to FIG. 5, each contact 24, 25 may be provided with a resilient clamp 46 which is preferably pushed onto the contact portions 26*a*, 27*a* and which serves to stabilise the relevant contact 24, 25 or to hold the members 26, 27 thereof together. The resilient clamp 46 is preferably of U-like form having slightly outwardly bent ends 46*a*, 46*b* in order to make it easier to push it onto the outer faces of the contact portions 26*a*, 27*a*.

The device according to the invention having the housing members 36, 37 and the contacts 24, 25 introduced therein is an adapter for cylindrical fuses in which the contact blades which are not present in the cylindrical fuses are formed by the portions 30*b*, 31*b* and therefore, when cylindrical fuses are used, there can also be used typical switching devices having lyre-shaped contacts which are configured per se to receive LVHRC fuses, that is to say, with such cylindrical fuses the contact blades not provided laterally are replaced by the contacts formed according to the invention.

The contacts 24, 25 used in the device preferably comprise brass or copper. The brackets 42 formed in the contacts 24, 25 in the base 28 are urged into the housing or the base 40 by press fitting and are introduced into a recess 44 provided therein, thus stemming the contacts relative to the housing.

It is further apparent from the above explanations that the portions 30*b*, 31*b* in the form of contact blades and the connection portions 30*a*, 31*a* are integrally formed with the contact 24, 25, respectively. The portions 30*b*, 31*b* consequently project in pairs out of the device according to the invention.

In a preferred embodiment, a total thickness of preferably approximately 2.4 mm is achieved by those portions 30*b*, 31*b* being doubled over, the material thickness of the portions 30*b*, 31*b* being approximately 1.2 mm. Owing to the projections 34, 35 at each of the portions 30*b*, 31*b*, which are preferably constructed so as to be planar, there is produced an outer dimension of the two portions 30*b*, 31*b* of a total of approximately from 3.2 to 3.4 mm which corresponds to a typical dimension for the thickness of a contact blade. The associated lyre-shaped contacts indicated in FIG. 1 also have a gap width of between 3.2 and 3.4 mm according to a preferred embodiment and are pressed together by springs, optionally as indicated in FIG. 1.

The resilient clamp 46 according to FIG. 5 constitutes, if it is used, an external resilient arrangement which is positioned over the portions 26*a*, 27*a*. In the embodiment illustrated, the portions 26*a*, 27*a* preferably have spacing from each other that is smaller than the width of the base 28.

Figure 4:
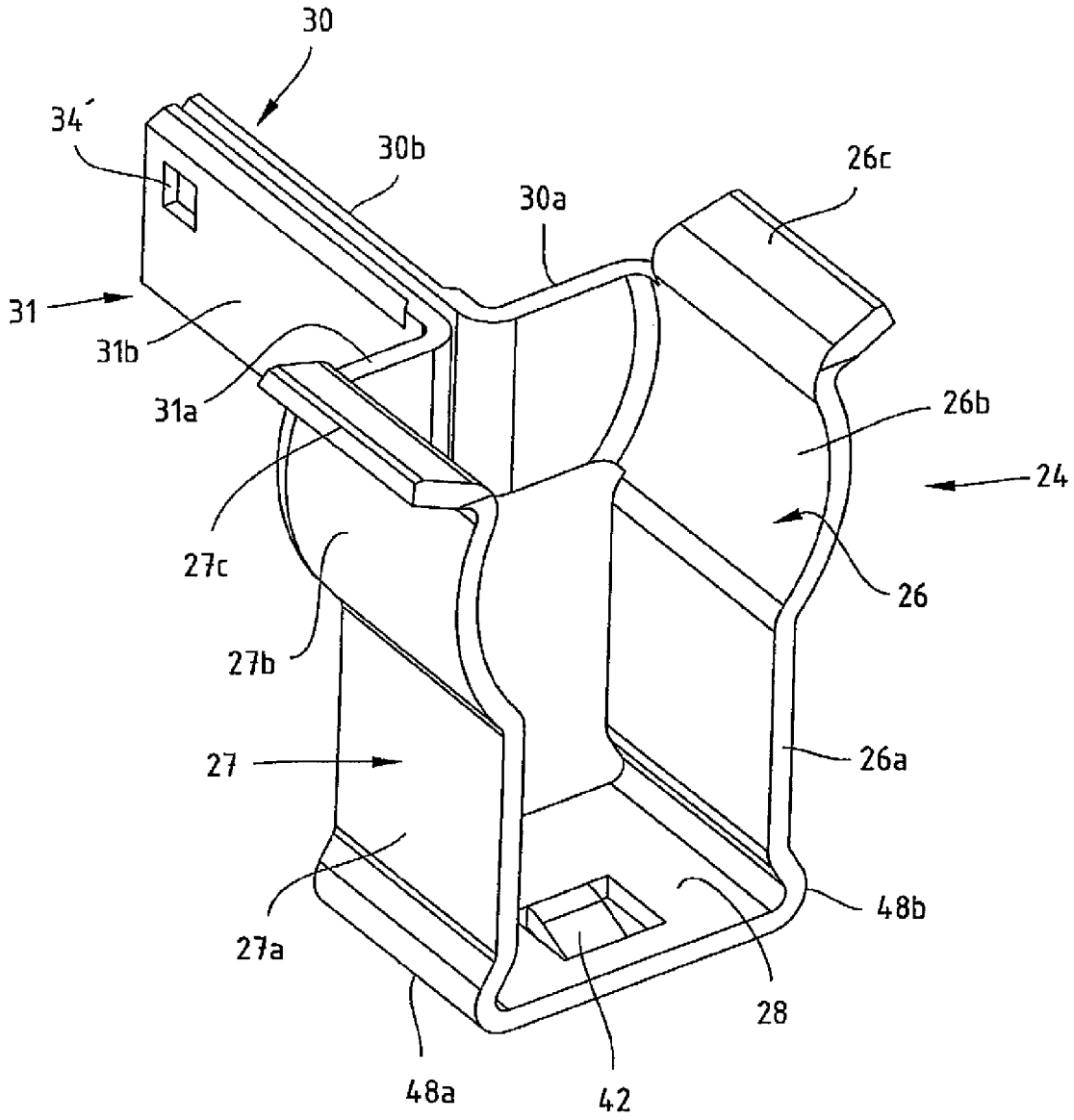
FIG. 4 is a perspective view of a contact.

The portions 26*a*, 27*a* in FIG. 4 have a delimitation 48*a*, 48*b* at the lower side thereof in the region of the base 28, whilst a lateral delimitation is formed by the curved portions 26*b*, 27*b* directed away from the base 28, which prevent displacement of the resilient clamp 46 in a direction parallel with the contact members 26, 27. After the resilient clamp 46 has been positioned on the contact, it is ensured that the resilient clamp 46 cannot slide either in the direction towards the base 28 or relative to the portions 26*b*, 27*b*.

By using the above-described device for receiving fuses of the type J30, J60 and optionally also J100, it is possible to use standard housings which have lyre-shaped contacts according to FIG. 1 and which are configured per se for LVHRC fuses having blade contacts. In the rest state of the contacts 24, 25 (FIGS. 4 and 5), the diameter defined by the bent portions 26*b*, 27*b* is preferably kept smaller than the outside diameter of the caps 18, 19 of the cylindrical fuses 15 to be introduced. After such a cylindrical fuse 15 has been introduced, consequently, the members 26, 27 are expanded, as a result of which the spacing between the portions 30*b*, 31*b* is also increased. This may absolutely be intended because, when the device is introduced into the receiving contact portions or lyre-shaped contacts, the portions 30*b*, 31*b* are pressed together again and therefore very good electrical contact is ensured.

The device according to the invention has, at each end face, a contact-blade-like contact piece which is formed in a planar manner and which is defined by the portions 30*a*, 30*b* or 31*a*, 31*b* which extend in an approximately L-shaped manner relative to each other, the portions 30*b*, 31*b* extending so far away from each other, in particular as a result of the projections 34, 35 or 34', 35', that those portions 30*b*, 31*b* are again compressed to a defined dimension and therefore the necessary contact force for the cylindrical fuses is produced when the device is introduced into the resilient contact receiving portions or lyre-shaped contacts in the housing 1 acting as the lower portion of the fuse.

The portions 30*a*, 30*b*, 31*a*, 31*b*, forming contact blades are constructed integrally on the end-face of the members of the contacts 24, 25 with a structure which is substantially T-like when viewed from above.

The invention claimed is:

1. A device for receiving a cylindrical fuse, having a housing which has member pairs which protrude from a housing base and which are spaced-apart from each other, wherein a substantially U-shaped contact is introduced between the members of each member pair and the member pairs are provided for receiving the fuse, wherein the substantially U-shaped contact is formed by two contact members, of which at least one of the contact members is provided with a contact tongue which protrudes laterally over the contact members, wherein the at least one contact tongue defines a contact blade, and wherein the contact members are connected to each other by a base portion, wherein a bracket is defined in the base portion and wherein the contact members are press-fit stemmed by the bracket relative to the housing, wherein the bracket is bent downwards and engages in a notch constructed in the housing base.

2. The device according to claim 1, wherein the substantially U-shaped contact has the base portion which is supported on the housing base.

3. The device according to claim 1, wherein the substantially U-shaped contact has a laterally bent portion.

4. The device according to claim 1, wherein the contact tongues of the substantially U-shaped contact have free ends which are arranged parallel with each other.

5. The device according to preceding claim 1, wherein fixing elements are provided on the base of the housing.

6. The device according to claim 5, wherein the fixing elements are arranged on the base of the housing in the opposite direction to the member pairs.

7. The device according to claim 1, wherein mutually parallel portions forming the contact blades are each provided with planar projections, by means of which the two portions are kept spaced-apart from each other.

8. The device according to claim 1, wherein the substantially U-shaped contacts have curved portions which define a part-circle for receiving a cylindrical fuse.

9. The device according to claim 8, wherein the curved portions which define the part-circle define a radius which is smaller than a radius of contact caps of the fuse to be introduced.

10. The device according to claim 1, wherein the substantially U-shaped contact has a straight portion which extends substantially perpendicularly to a base of the substantially U-shaped contact.

11. The device according to claim 10, wherein a resilient clamp is positioned over the straight portions of the substantially U-shaped contact.

12. A switching device, in particular a load breaking switch, having a cover and a housing portion, there being arranged in the housing portion a plurality of contact receiving portions, including lyre-shaped contacts, which are arranged in pairs, and having at least one device for receiving a fuse, in particular according to claim 1, characterised in that the devices are arranged on the lower side of the cover for pivoting with the cover.

13. The switching device according to claim 12, wherein the devices are releasably secured to the lower side of the cover so as to be substantially parallel with each other and in that the contact blades which project laterally from the devices can be moved into engagement with the contact receiving portions by the cover being pivoted.

* * * * *